US005260688A

United States Patent [19]

Curry et al.

[11] Patent Number: 5,260,688

[45] Date of Patent: Nov. 9, 1993

[54] CRANE HOIST SAFETY DEACTIVATOR

[76] Inventors: John R. Curry, 419 E. Walnut Ave., El Segundo, Calif. 90245; Donald A. Chambers, 1190 W. Grant, Wilmington, Calif. 90744

[21] Appl. No.: 864,411

[22] Filed: Apr. 6, 1992

[51] Int. Cl.[5] ..... G08B 1/08; B66C 13/18

[52] U.S. Cl. ..... 340/539; 340/673; 340/685; 212/149; 212/153; 361/1

[58] Field of Search ..... 340/539, 685, 689, 679, 340/683, 673, 825.06, 825.69, 825.72; 212/149, 153, 156; 361/1; 192/129 R A, 116.5, 127, 125 A

[56] References Cited

U.S. PATENT DOCUMENTS

| | | | |
|---|---|---|---|
| 2,814,032 | 11/1957 | Agnew et al. | 340/685 |
| 3,823,395 | 7/1974 | Rigney et al. | 340/685 |
| 3,824,578 | 7/1974 | Harders | 340/685 |
| 3,956,742 | 5/1976 | Karl | 340/539 |
| 3,969,714 | 7/1976 | Greer | 340/685 |
| 4,003,482 | 1/1977 | Cheze | 212/149 |
| 4,238,037 | 12/1980 | Azovtsev | 212/149 |
| 4,350,254 | 9/1982 | Noly | 212/153 |
| 4,732,286 | 3/1988 | Koenig | 340/685 |
| 4,743,893 | 5/1988 | Gentile | 340/685 |
| 4,753,357 | 6/1988 | Miyoshi | 212/161 |
| 4,787,524 | 11/1988 | Cobb | 212/150 |
| 4,804,095 | 2/1989 | Rohr | 212/152 |
| 4,821,835 | 4/1989 | Latvys | 212/149 |
| 5,058,752 | 10/1991 | Wacht et al. | 212/150 |

*Primary Examiner*—Donnie L. Crosland
*Attorney, Agent, or Firm*—Fulwider Patton Lee & Utecht

[57] ABSTRACT

Sensors mounted on respective cargo transport trucks transferring cargo to a hoisting crane and responsive to an unsafe condition in such trucks to generate an electrical safety signal to be transmitted to such crane for rendering the hoisting mechanism inoperative.

14 Claims, 4 Drawing Sheets

CRANE HOIST SAFETY DEACTIVATOR

BACKGROUND OF THE INVENTION

1. Field of the Invention

The present invention relates generally to cargo transfer cranes and particularly to a hoisting crane for loading and unloading cargo ships.

2. Description of the Prior Art

It is well known that the cost of lay days for a ship in harbor for on loading or off loading can prove particularly expensive to a ship's owner. Consequently, various methods have been developed for expediting the on loading and off loading of ships. One such method contemplates the loading of pieces of cargo in large containers to be contained therein for transfer to and from the ship as a unit. These containers are then hoisted directly from the trailer at dock side by a gantry crane which then transfers them to the ship's hold.

The rate of compensation which must be made to longshoreman personnel and truckers providing the labor associated with maritime cargo transfer is such as to demand the utmost efficiency in achieving such transfer. Because of the inordinate weight associated with the loaded cargo containers, safety is of extreme importance in avoiding dislocation thereof which may cause damage to the cargo and, more importantly, personal injury to the dock workers.

Truck drivers are often paid on a piece basis thus providing considerable incentive for rapid unloading of cargo from trailers towed by their truck tractors. The containers are typically loaded on the truck trailers and locked thereto to prevent shifting of the containers relative to the trailer during transport to the dock site. A recognized problem is the fact that the truckers or other responsible personnel, from time to time, neglect to unlock such locking mechanism thus leaving the container locked to the truck as the crane hoisting mechanism raises the container. This oftentimes results in lifting of the truck itself and sometimes the attached truck tractor with the driver aboard. Then, when the locking mechanism fails, or otherwise releases, freeing the trailer from the container, the trailer and truck tractor may be dropped on to underlying dock from a considerable height, such as 20 or more feet above the dock, often resulting in damage to the truck and trailer and injury to the driver. Consequently, there exists a need for a safety apparatus which will limit hoisting of such container when locked to the trailer.

Detection systems have been proposed in transfer cranes for detecting and controlling the distance between multiple trolleys mounted on such crane. A device of this type is shown in U.S. Pat. No. 4,753,357 to Miyoshi. While satisfactory for their intended purpose, such devices fail to detect an unsafe condition in a cargo truck transporting cargo to the crane.

Other mechanisms have been proposed for detecting the attitude of a crane to indicate an unsafe condition. A device of this type is shown in U.S. Pat. No. 4,743,893.

Still further devices have been proposed for detecting potential collision between material handling devices and to protect against such collisions. A device of this type is shown in U.S. Pat. No. 2,814,032 to Agnew et al. Crane safety cut off and overload devices have been proposed to enhance the safety of the operator and attendant personnel. Devices of this type are shown generally in U.S. Pat. Nos. 4,804,095 to Rohr et al., 4,003,482 to Cheze, 4,787,524 to Cobb et al. and 5,058,752 to Wacht et al., as well as U.S. Pat. No. 4,821,835 to Latvys et al. and 3,824,578 to Harders. However, none of these devices detect an unsafe condition in a cargo transport truck or respond to such a condition to render a loading crane inoperative.

SUMMARY OF THE INVENTION

The apparatus of the present invention is characterized by a detector on a cargo truck for detecting an unsafe condition and transmitting a signal to a hoisting crane for rendering such crane inoperative or otherwise correcting operation of such crane. In one aspect of the invention, the trucks are equipped with transmitters operating on different frequencies such that a frequency associated with different ones of a multiple of cranes might be selected.

Other objects and features of the invention will become apparent from consideration of the following description taken in conjunction with the accompanying drawing.

DESCRIPTION OF THE PREFERRED EMBODIMENT

Figure 3:
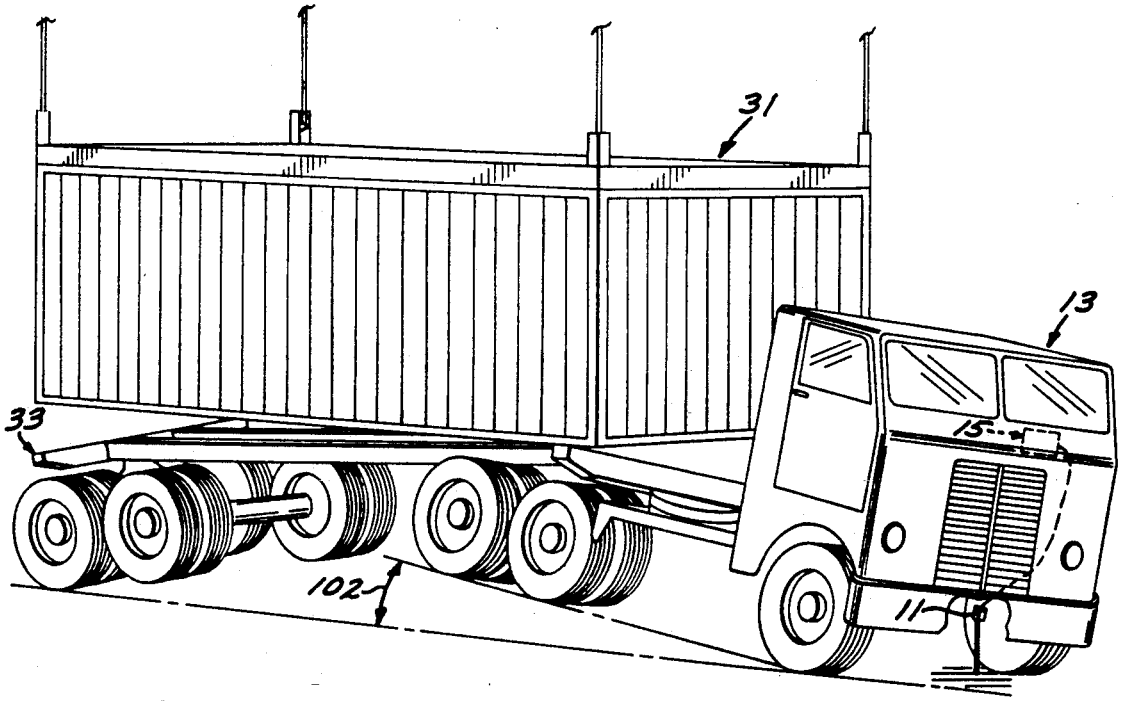
FIG. 3 is a perspective view, similar to FIG. 1, but showing a corner of the trailer being hoisted with the container.

The crane safety apparatus of the present invention includes, generally, a detector wand 11 which may be suspended from the front bumper of a truck tractor by means of a switch box 12. Such switch box is electrically coupled with a control housing mounted in the truck cab for convenient access by the driver. Housed in the housing 15 is an electrical circuit, generally designated 17 (FIG. 4), which includes a plurality of parallel connected transmitters 19, 21 and 23, actuated by the detector wand 11 upon contact of such detector wand with the ground as shown in FIG. 3 to transmit a safety signal to a switch controller 25. Such controller is connected in circuit with the control circuit controlling power to the gantry crane, generally designated 27. Such switch controller 25 is then operative to deactuate such control circuit and consequently the lifting mechanism, generally designated 29, to discontinue lifting of the cargo container, generally designated 31 (FIG. 3), carried on the truck trailer 33.

In the loading of cargo onto ocean going ships, the individual units of cargo are typically loaded into large containers 31, frequently at an inland site and such containers then transported to the dock area and either temporarily stored or loaded directly onto the ship, generally designated 61, by means of a gantry, or hammerhead, crane 27. Due to the significant expense of lay days while a ship is in dock, it is important that such loading be achieved in a relatively rapid manner.

Typically, the containers incorporate hold down mechanisms at the four bottom corners which are manually actuated to lock the container onto the trailer 3 to prevent shifting during transport over the roadway. When the trailer reaches the unloading location on the dock, it is the responsibility of the truck driver or other personnel to manually unlock such container locking mechanisms to disengage them from the trailer itself. From time to time, in the rush for rapid off-loading of the trailer, the responsible personnel will neglect to unlatch the latching mechanism or the latching mechanism itself may become hung up in the trailer, thus preventing full unlatching thereof. For the purpose of demonstration herein, a situation is depicted in FIG. 3 where the latching mechanism of the front right corner of the container 31 is shown as remaining latched to the trailer 33 during hoisting of the trailer by means of the crane 27. It will be appreciated that, in practice, all four corner locks may be inadvertently left locked resulting in the entire trailer being hoisted off the dock.

In at least some instances, the locks have remained engaged to the point where the lifting mechanism 29 (FIG. 1) has raised the trailer 33 to the elevation where it and the attached tractor 13, are lifted to a substantial elevation above the deck of the dock. Then when the mechanical lock, or locks, unlock or fail under the weight of the hoisted truck and trailer, the trailer is freed to drop to the deck of the dock. The resulting high impact contact can cause great damage to the equipment and result in injury to any truck driver remaining in the cab of the tractor 13.

Figure 1:
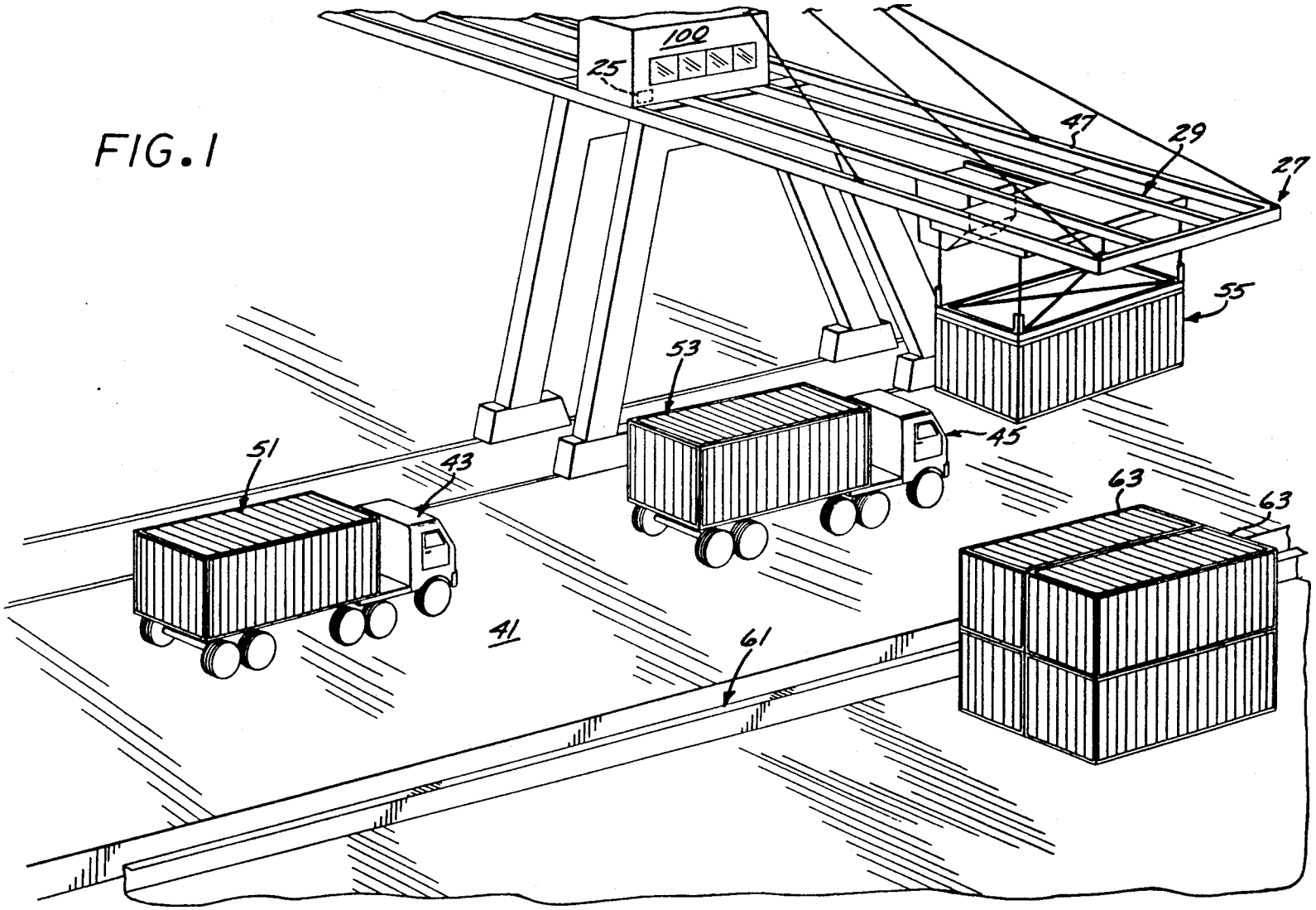
FIG. 1 is a perspective view of a cargo safety apparatus embodying the present invention.
Figure 2:
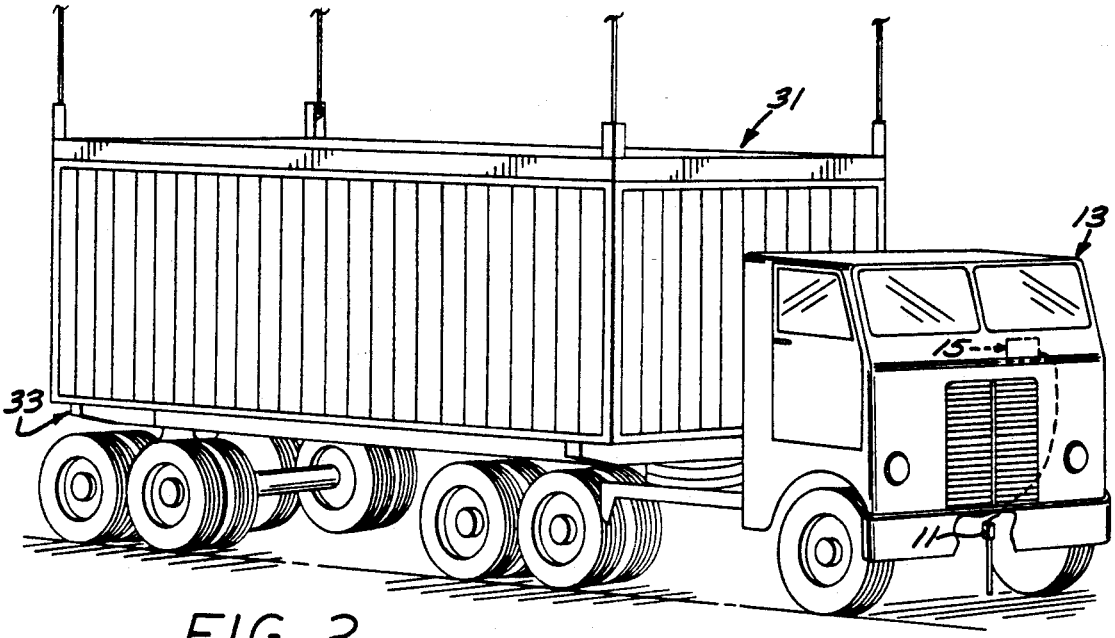
FIG. 2 is a perspective view, in enlarged scale, of a truck trailer shown in FIG. 1 being prepared for off loading of a container.

In many instances, a number of cranes 27 are employed on a dock 41 for loading into one or more holds of a ship being serviced by a number of transport trucks, such as the truck 13, accompanied by additional trucks, generally designated 43 and 45 (FIG. 1). The cranes 27 typically incorporate an overhang formed by a plurality of parallel tracks 47 from which is suspended a trolley carrying the hoisting mechanism 29. Suspended therefrom is a spreader 50 for locking on to the top of the various containers 55 to hoist the containers 51 and 53 from the trucks 43 and 45 to be suspended from such trolley. The trolley then carries the hoisting mechanism 29 along the rails 47 to a location over the ship 61 to deposit the individual containers 63 on the deck or in the ship's hold as the case may be.

Figures 4, 5:
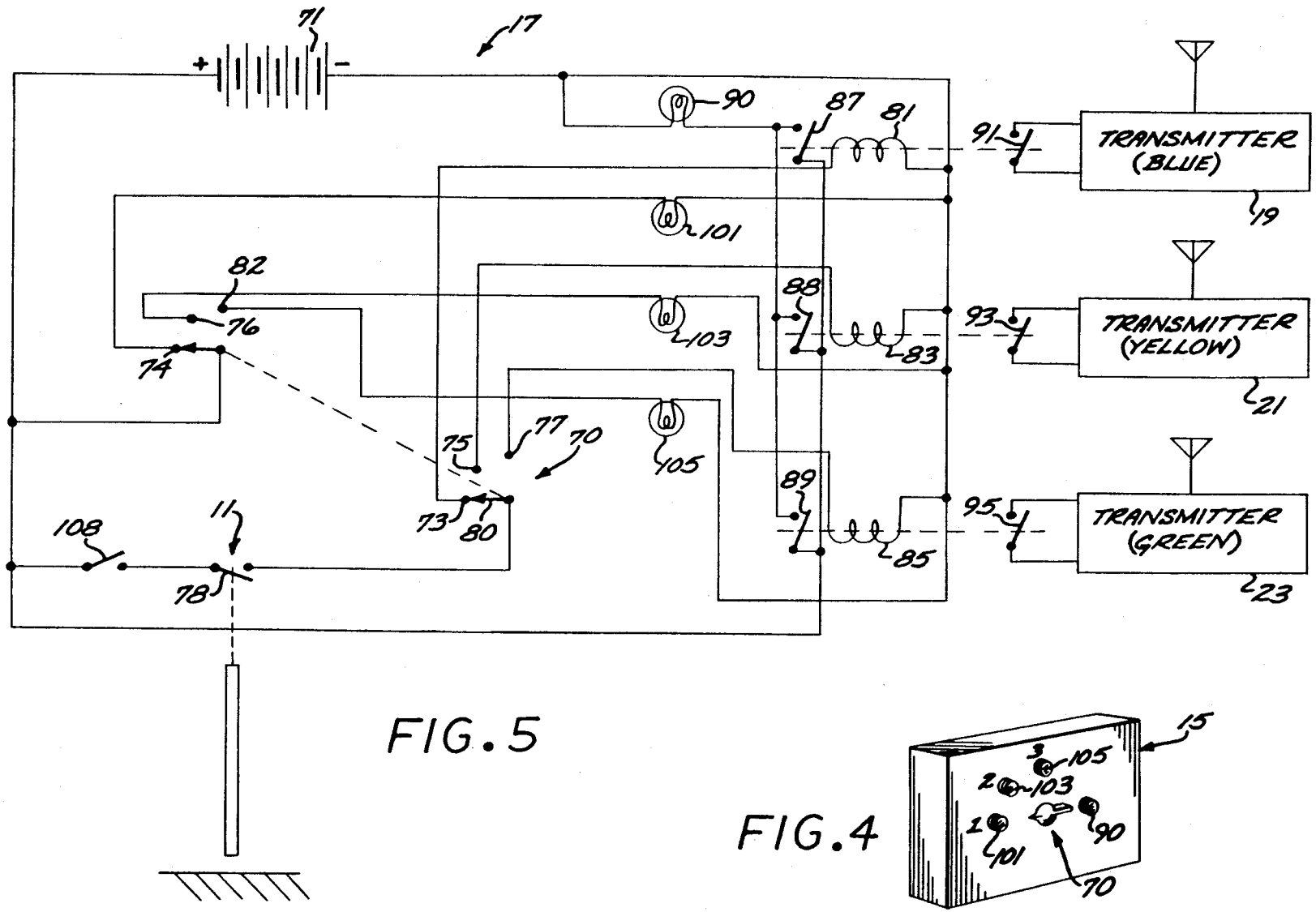
FIG. 4 is a perspective view, in enlarged scale, of a control box included in the apparatus shown in FIG. 3.
FIG. 5 is a schematic of an electrical system incorporated in the safety apparatus shown in FIG. 1.

The control housing 15 may be in the form of a box housing the electrical circuit 17 (FIG. 4). The electrical circuit 17 connects the battery 71 across a three position, double throw, rotary switch including three pairs of switch contacts 73, 75, and 77 and 74, 76 and 82. One wiper 80 of the switch 70 is connected in series with a detector switch 78 coupled with the wand 11 and with a mercury switch serving as an lockout switch. The contacts 73, 75 and 77 of the switch 70 are connected in series with respective relay solenoids 81, 83 and 85 which control respective actuating switches 87, 88 and 89 coupled with respective transmitter switches 91, 93 and 95 in the respective transmitters 19, 21 and 23. Connected in parallel with the respective solenoids 81, 83 and 85 by means of leads from the respective contacts 74, 76 and 82 are respective blue, yellow and green indicator lights 101, 103 and 105.

The mercury lockout switch 108 is mounted on the housing 15 and arranged as an inclinometer so that it is closed to complete a circuit only when the tractor is tilted to or above the angle shown in FIG. 3.

Shown in the exemplary embodiment are three different transmitters 19, 21 and 23, each adapted to transmit at a selected frequency to which a receiver 121 (FIG. 6) included in the controller of an individual crane is responsive. In practice, the transmitters and associated receivers may take many different forms. For instance, the transmitters may be in the form of infra red lamps mounted on tops of the respective cabs and operative to transmit a beam to an optical sensor mounted on, for instance, the front rail of the spreader 50.

In the exemplary embodiment, the transmitters 19, 21 and 23 are themselves of the type typically utilized as a remote actuator for an automobile alarm system of the type sold under the trade designation POP-A-LOCK by Design Tech Int'l, Inc., 7401 Fullerton Road, Springfield, Va. 22153.

Each transmitter 19, 21 and 23, designated herein as blue, yellow and green, respectively, is then associated with a respective blue, yellow or green indicator light 101, 103 or 105. This provides an indication of the selected transmitter being rendered operative to identify the particular crane 27 on which the receiver responsive to that frequency is mounted.

Connected in series with the respective switches 87, 88 and 89 is an indicator light 90.

The controller 25 (FIG. 1) is typically mounted on the crane sill beam but, for clarity, is depicted herein as being mounted on the front wall of the crane machinery house, generally designated 100.

Figure 6:
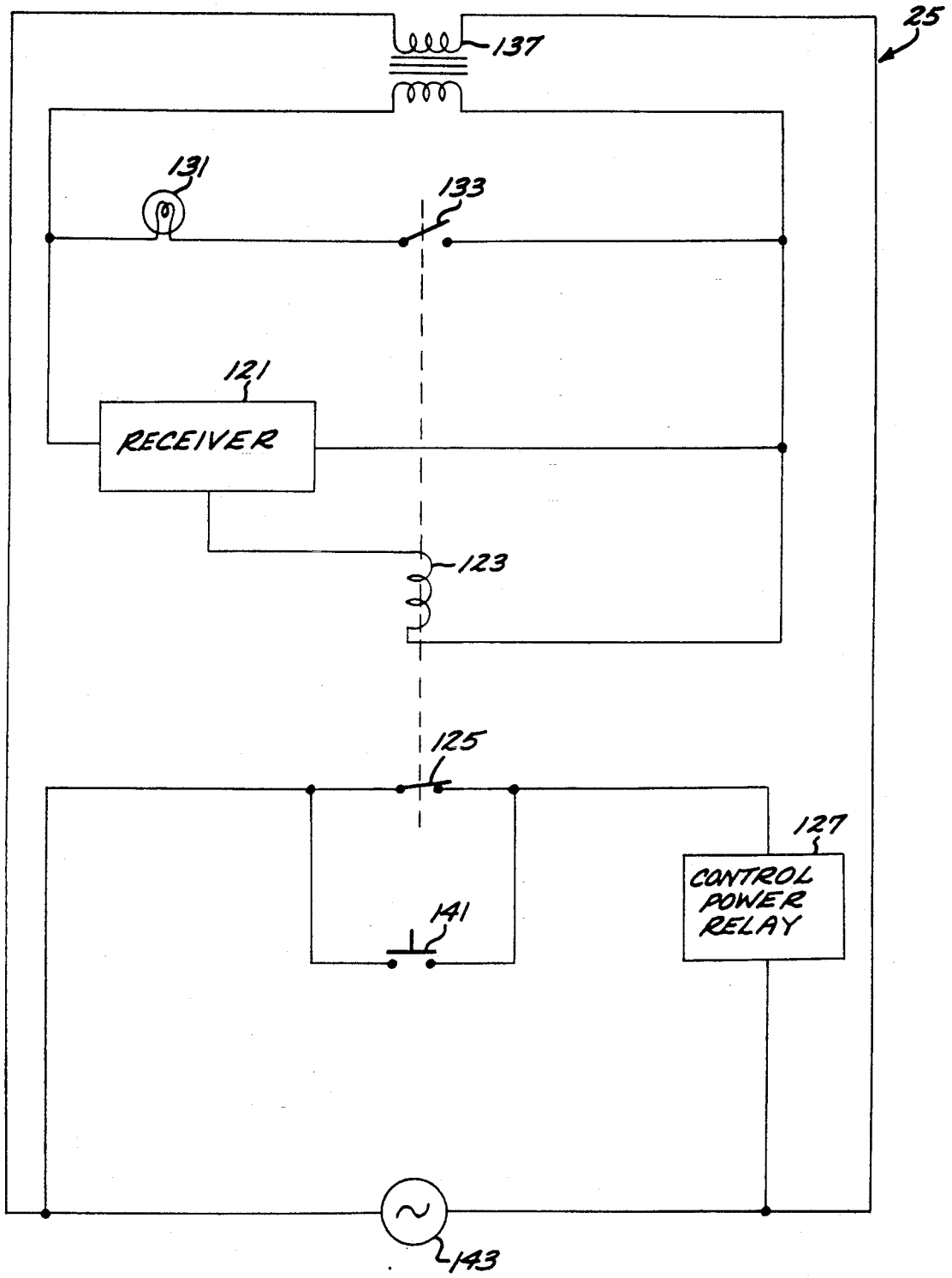
FIG. 6 is an electrical diagram of the gantry crane deactuating circuit incorporated in the invention shown in FIG. 1.

Referring to FIGS. 5 and 6, the controller 25 includes a discriminating receiver 121 responsive to the radio signal from the blue transmitter 19 and is connected across a solenoid 123 which actuates a normally closed switch 125 connected across a 120 volt control power relay 127 which controls all power, including that to the lifting mechanism 29. Connected across the receiver 121 is an indicator light 131. The light 131 is mounted on the controller housing and is connected in series with an indicator switch 133 controlled by the relay solenoid 123. A step-down power supply 137 is incorporated in the receiver circuit for powering the solenoid 123.

The control circuit for the power supplied to the hoisting mechanism 29 includes a key operated switch 141. The switch 141 is mounted on the controller housing (not shown) and is connected in parallel with the solenoid actuated switch 125 for manually controlling power from the AC power source 143 to the control relay 127.

It will be appreciated by those skilled in the art that the switch box 12 may be conveniently mounted, for instance, behind the front bumper of the truck tractor 13. The detector wand 11 may be adjusted to the desired height to set the angle 102 (FIG. 3) to which the rear of the tractor 13 must be inclined to cause closure of the inclinometer lockout switch 108 (FIG. 5). In the preferred embodiment, the angle is established to limit hoisting of the rear wheels of the trailer to about 12 inches above the dock.

It will also be appreciated by those skilled in the art that the detector itself may be of any convenient form which will be responsive to inclination of the tractor or elevation of the rear wheels thereof or even the elevation of the trailer or some portion thereof.

In operation, a detector wand 11 will be mounted on each of the trucks 13, 43 and 45 to be utilized in transporting cargo containers to the hoisting mechanisms of the various cranes being utilized to load the ship 61 or associated ships moored at the dock 41. The controller 25 will be installed either on the hoisting mechanism 29 or on the machinery house 100 as shown in FIG. 1 and will be connected in series with the hoisting motor of such mechanism.

When a truck 13, 43 or 45 is then servicing a particular crane, as for instance the crane 27, having a receiver 121 tuned to the same frequency as the blue transmitter 19, the truck driver will rotate the selector switch 70 (FIG. 4) to the contact 73. This then arms the transmitter 19 leaving the yellow and green transmitters 21 and 23 disarmed. Should the unfortunate event occur that the driver or attending personnel fail to unlatch the container latching mechanism associated with the trailer 33 and the hoisting mechanism 29 be actuated to lift, for instance, the container 31 shown in FIG. 3, thus raising the trailer, the rear of the tractor 13 will be elevated as shown. Such elevation of the rear of the tractor will lower the front bumper to such a degree as to cause the mercury switch 108 to close and the detector wand 11 to engage the surface of the dock. Engagement of such wand and continued elevation of the rear of the trailer will cause such wand to close the detector switch 78 (FIG. 5) thereby energizing the solenoid 81 and the indicator light 101. The solenoid 81 is then operative to close the switches 87 and 91 thus energizing the indicator light 101 and armed transmitter 19 to thereby emit a safety signal to the controller 25.

The receiver 121 (FIG. 6) of the controller 25 associated with the crane 27 hoisting the container 31 will then respond to energize the control solenoid 123 and close the indicator switch 133 and open the control switch 125 to energize the indicator light 131 and the control relay 127 thereby de-energizing the hoisting motor in the hoisting mechanism 29. This then serves to stop the lifting action on the truck at a point where it remains safe for the truck and driver.

The crane operator may then insert a key in the override switch 141 and close that switch to re-energize the control power relay to thus provide power to enable him to reverse the hoisting motor to lower the container 31 and, consequently, the tractor 13 thereby avoiding damage to the machine and injury to the truck driver.

The attendant personnel may then check the container locking mechanism to be assured that it is released for disengagement from the trailer. The hoisting mechanism may be then actuated to hoist the container 31 clear of the trailer 33.

Should the wand 11 at any time, while the truck is in its normal level position on the deck be deflected, as by being bumped or kicked without inclination of the truck, the mercury switch 108 will remain open to prevent unwanted activation of the transmitters 19, 21 and 23.

It will be apparent to those skilled in the art that when the trucks 13, 43 and 45 are to be utilized with a gantry crane different from the crane 27 and having a controller 25 with a receiver tuned to a frequency of either the transmitter 21 or 23, the three contact switch 70 will be manually rotated to arm the transmitter 21 or 23 associated with that crane. Should the truck then, while delivery to such crane, be hoisted sufficiently to cause the detector wand 11 to engage the ground and close the switch 78, the associated transmitter 21 or 23 will be actuated to transmit a radio signal to the controller of that crane to thereby render the lifting mechanism associated therewith inoperative pending reset thereof. This feature avoids the problem which would otherwise exist due to the fact that the receivers in cranes adjacent to the crane being serviced by the offending truck would respond to the transmitted signal and thus be rendered inoperative.

From the foregoing, it will be appreciated that the safety apparatus of the present invention provides a convenient, economical and reliable apparatus for assuring safe off loading of containers 31 from the trailers 33 without subjecting the tractor 13 or driver to damage or injury from inadvertent elevation of such tractor above the surface of the dock.

Various modifications and changes may be made with regard to the foregoing detailed description without departing from the spirit of the invention.

What is claimed is:

1. Safety apparatus for controlling operation of a lifting crane in response to an unsafe condition in one of a plurality of trucks transporting cargo to or from said crane to deactuate an electrical circuit controlling electrical power to a lifting mechanism attachable to the cargo transported on said trucks and comprising:

sensors mounted on said trucks and responsive to said unsafe condition to generate an electrical safety signal;

transmitters connected in circuit with said sensors and responsive to said safety signal to transmit an operational signal;

deactuator switch mounted on said crane;

a switch control responsive to said operational signal to deactuate said deactuator switch whereby said sensors sense said unsafe condition of a truck to which said lifting mechanism is connected to thereby generate said safety signal and cause said switch control to deactivate said deactuator switch to deactivate said lifting mechanism.

2. Safety apparatus as set forth in claim 1 wherein:

said sensors each includes an inclinometer for sensing the attitude of the respective said trucks.

3. Safety apparatus as set forth in claim 1 for use with trucks traveling on a support surface and including trailers for transporting said cargo and wherein:

said sensors include feeler wands mounted on the respective said trucks and projecting therefrom a sense when some portion of the respective said trucks is elevated to a predetermined height above said surface to generate said safety signal.

4. Safety apparatus as set forth in claim 1 wherein said trucks are on a truck support surface and wherein:

said transmitters include respective transmitter switches connected in circuit with said sensors and operative in response to said safety signal to actuate said transmitters to generate said safety signal; and said sensors include respective solenoids controlling respective said transmitter switches, actuating switches connected with respective said solenoids, and detectors connected in circuit with said solenoids for sensing the position of the trucks relative to said truck support surface and each of said sensors operative in response to some portion of said truck raised to a predetermined height relative to said support surface to close said transmitter switches to generate said safety signal.

5. Safety apparatus as set forth in claim 1 for use with a plurality of cranes and wherein:

said transmitters include means for generating at least one said operational signal with a preselected characteristic; and said switch control includes means responsive only to said operational signal with said preselected characteristic.

6. Safety apparatus as set forth in claim 1 wherein:

said transmitter is operative to generate a radio signal defining said operational signal; and said switch control includes a radio receiver responsive to said operational signal.

7. Safety apparatus as set forth in claim 1 for use with a ship's loading crane and truck tractor and trailer combinations and wherein:

said sensors are in the form of detectors mounted on the truck tractors for detecting the elevation of some portion thereof.

8. Safety apparatus as set forth in claim 7 wherein:

said transmitter is operative to generate a radio signal defining said operational signal; and said switch control includes a radio receiver responsive to said operational signal.

9. Safety apparatus as set forth in claim 7 for use with a plurality of such ship loading cranes and wherein:

said transmitters include means for generating at least one said operational signal with a preselected characteristic; and said switch control includes means responsive only to said operational signal with said preselected characteristic.

10. Safety apparatus as set forth in claim 7 wherein:

said sensors includes respective feeler wands mounted on the respective trucks and projecting therefrom to, in the event any of the respective cargo becomes hooked to and remains hooked to the respective such trailer, sense elevation of some portion of the respective trucks to a predetermined height to generate said safety signal.

11. Safety apparatus as set forth in claim 1 wherein at least one of said trucks is on a truck support surface and wherein:

said transmitters include respective transmitter switches connected in circuit with said sensors and operative in response to said safety signal to actuate said transmitters to generate said safety signal; and said sensors include respective solenoids controlling respective said transmitter switches, a selector switch mounted on one of said trucks connected in series with one of said respective solenoids, and detectors connected in circuit with said respective solenoids across said selector switch for sensing the position of said one of said trucks relative to said truck support surface and at least one of said sensors operative in response to some portion of said one of said trucks being raised to a predetermined height relative to said support surface to close said respective transmitter switch to generate said safety signal.

12. Safety apparatus as set forth in claim 1 that includes:

lock-out switches mounted on the respective said trucks and connected with the respective said sensors, said lock-out switches being responsive to a selected inclination of the respective trucks to arm the respective sensors for generating such safety signal.

13. Safety apparatus as set forth in claim 1 that includes:

housings housing the respective transmitters and carrying the respective sensors, said housings being mounted on said trucks.

14. Safety apparatus for controlling operation of a lifting crane in response to an unsafe condition in one of a plurality of trucks transporting cargo to or from said crane to deactuate an electrical circuit controlling electrical power to a lifting mechanism attachable to the cargo transported on said trucks and comprising:

housings for mounting from said trucks;

sensors mounted on said housings and, when mounted on said trucks, responsive to an unsafe condition to generate an electrical safety signal;

transmitters in said housings connected in circuit with the respective sensors and responsive to said safety signal to transmit an operational signal;

a deactuator switch for mounting on said crane;

a switch control connected with said deactuator switch and responsive to said operational signal to deactuate said deactuator switch whereby said sensors will sense such unsafe condition in the respective trucks to which said lifting mechanism is connected to thereby generate said safety signal and cause said switch control to deactivate said deactuator switch to deactivate said lifting mechanism.

* * * * *